United States Patent [19]

Risch

[11] Patent Number: 4,804,309

[45] Date of Patent: Feb. 14, 1989

[54] GRIPPING DEVICE FOR BOOM-MOUNTED WORK TOOL

[76] Inventor: Joel V. Risch, 3275 Lucia Ave., Eureka, Calif. 95501

[21] Appl. No.: 103,999

[22] Filed: Oct. 1, 1987

[51] Int. Cl.[4] ..... E02F 3/413

[52] U.S. Cl. ..... 414/704; 37/DIG. 3; 37/DIG. 12; 414/723; 414/740

[58] Field of Search ..... 414/704, 723, 724, 726, 414/740; 37/DIG. 12, DIG. 3, 117.5

[56] References Cited

U.S. PATENT DOCUMENTS

| | | | |
|---|---|---|---|
| 2,776,768 | 1/1957 | Carlson | 414/740 X |
| 3,077,999 | 2/1963 | Svoboda | 414/726 X |
| 3,148,787 | 9/1964 | Clark et al. | 414/740 |
| 3,250,028 | 5/1966 | Hunger et al. | 37/117.5 |
| 3,477,602 | 11/1969 | Peterson | 414/704 |
| 3,559,314 | 2/1971 | Funk | 414/740 X |
| 3,842,999 | 10/1974 | Asbury | 414/724 |
| 3,854,608 | 12/1974 | Arnold | 37/117.5 X |
| 3,972,097 | 8/1976 | Schakat | 414/704 X |
| 4,375,345 | 1/1983 | Hanson | 37/DIG. 3 X |
| 4,466,494 | 8/1984 | Hanson | 414/740 X |
| 4,519,739 | 5/1985 | Risch | 414/724 |
| 4,668,156 | 5/1987 | Mason | 414/740 X |

FOREIGN PATENT DOCUMENTS

| | | | |
|---|---|---|---|
| 222063 | 5/1985 | German Democratic Rep. | 37/117.5 |
| 58-339 | 4/1983 | Japan | 414/723 |
| 2169582 | 7/1986 | United Kingdom | 37/DIG. 3 |

OTHER PUBLICATIONS

Wain-Roy, Inc., literature on "the versatile jaw backhoe bucket".
Weldco, literature on "Excavator Attachments I".
Stanley, literature on "breaker claw".
Werk-Brau Co., Inc., literature on "E-Z Grip".
Mann Corporation, literature on "Fill-Line Rake Attachments".

*Primary Examiner*—Leslie J. Paperner
*Attorney, Agent, or Firm*—Townsend and Townsend

[57] ABSTRACT

A gripping claw for a backhoe, breaker, or similar device is secured to the end of a boom in a pivotal manner. Attachment is achieved through a pair of plates joined together facing each other, with the claw pivotally mounted at one end in the space between the plates. A piston and cylinder, also mounted in the space between the plates, joins the plates to a second location on the claw, both being pivot connections, so that extension and retraction of the piston causes the claw to pivot between open and closed positions. To install the attachment on a boom-mounted tool, the tool is detached from the boom, and the attachment inserted in its place, with the tool in turn secured to the attachment. The attachment thus serves as an extension, and is readily installed and removed on site.

13 Claims, 2 Drawing Sheets

GRIPPING DEVICE FOR BOOM-MOUNTED WORK TOOL

This invention relates to remote-control power equipment for excavating and construction.

BACKGROUND OF THE INVENTION

Various types of boom-mounted equipment are used in the construction and demolition industry for manipulating and operating upon objects too large to be dealt with manually or at locations otherwise unreachable. The booms are tractor mounted and remote controlled, and are used for such tools as buckets, backhoes, excavator rakes, grapples, breakers and cutters. The tools are manipulated by hydraulic cylinders attached to the boom.

Some jobs require a gripping claw in association with the tool, so that the claw and tool can grip or clamp material from both sides, rather than just push or scoop the material. The combination of claw and tool makes it considerably easier to reposition material and to pick it up and set it down as needed. For example, claws attached to breakers can easily reposition large boulders for breaking, and claws attached to such items as buckets or backhoes can be used to remove logs or pipe from a site.

Claws of this type must be capable or opening and closing, and in some cases, complete retraction. Accordingly, they are typically attached in one or two ways. In the first way, the claw is pivotally joined to the tool, with a pivoting link further joining the claw to the boom. The claw in this arrangement pivots simultaneously with the tool, although in the opposite direction. As a result, it can only close against the tool when the tool is at a particular angle with respect to the boom. The tool cannot then be manipulated without opening the claw. In the second way, the claw is mounted to pivot independently of the tool, and has its own hydraulic cylinder mounted on the boom for this purpose. The disadvantage of this arrangement is that the hydraulic cylinder is bulky, not readily attached or removed, and exposed such that it is vulnerable to damage. Also if one were to rotate the tool with the object still gripped by the clamp, one would have to rotate the clamp at the same time in synchronous manner, a difficult maneuver. Still further, claws with hydraulic cylinders mounted on the boom cannot be used with many types of equipment with extendable booms.

SUMMARY OF THE INVENTION

A novel device has now been developed which serves the function of an independently movable claw and avoids the disadvantages of the existing structures. The device is an extension piece which is incorporated into the construction by detaching the tool from the boom and inserting the extension piece in between the two as a removable link. A claw or gripping member is pivotally mounted on the extension piece and is further joined to the extension piece by an extendable arm such as a hydraulic cylinder, which operates independently of the boom or the tool itself.

In preferred embodiments the extension piece is formed of two plates mounted to each other with a space in between, and the hydraulic cylinder is mounted inside the space, where it is protected against being struck by external objects as the boom and tool are maneuvered. Operation of the piston and cylinder is done by remote control in the same manner as the hydraulic arm mounted to the boom which controls the angle of the tool.

The extension piece is installed using the same mounting connections on the boom and tool used for mounting the latter to each other. In preferred embodiments, removable pins are used, permitting quick and simple assembly of the parts, which may be done on site. No connections are needed to the boom itself, and the attachment is thus applicable to a wide variety of boom and tool constructions.

Further advantages and embodiments of the invention will be apparent from the following description.

DETAILED DESCRIPTION OF THE INVENTION AND PREFERRED EMBODIMENTS

Figure 1:
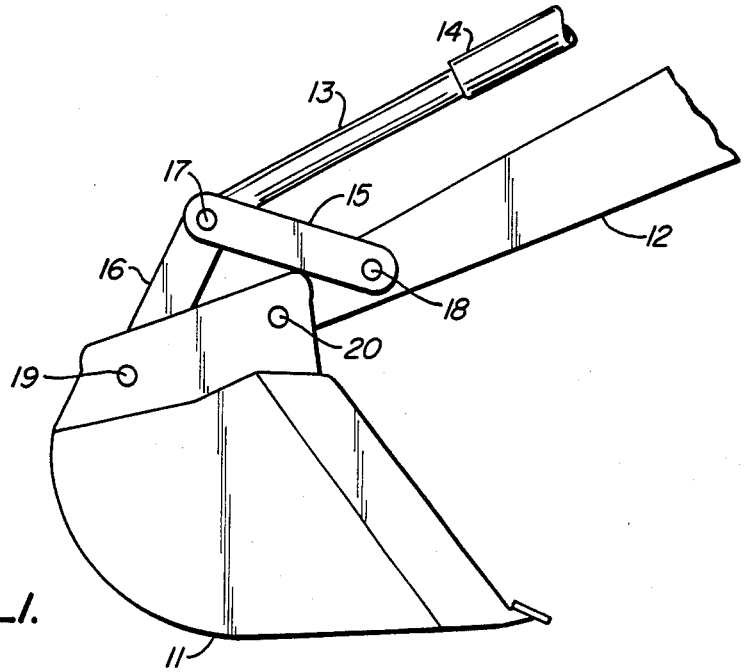
FIG. 1 is a side view of one example of a boom-mounted tool to which the present invention may be applied, prior to insertion of the extension piece.

FIG. 1 illustrates the working end of a boom-mounted hydraulic bucket. The parts include the bucket 11, whose open side is on the right in the view shown in the drawing, the boom 12 on which the bucket is mounted, and a hydraulic piston 13 and cylinder 14 which function as an extendable arm to pivot the bucket. The cylinder is mounted to the side of the boom 12, and is operated in the conventional manner by remote control from the tractor on which the boom 12 is carried. A pivot link 15 joins the piston and the boom 12, and the actual connection between the piston and the bucket 11 is a second pivot link 16. As the piston is drawn back into the cylinder, the first pivot link 15 rotates clockwise around the pivot connection 18, drawing the second pivot link 16 with it and rotating the bucket 11 clockwise as well around the pivot connection 20. The inclusion of these two pivot links provides the bucket with a wide range of motion upon extension and retraction of the hydraulic piston 13 and cylinder 14. The parts are joined by four connections 17, 18, 19 and 20, all of which are pivot joints. Similar pivot connections on other types of tools, such as breakers, rakes, grapples, etc. will be similarly positioned and will function in substantially the same way.

Figure 2:
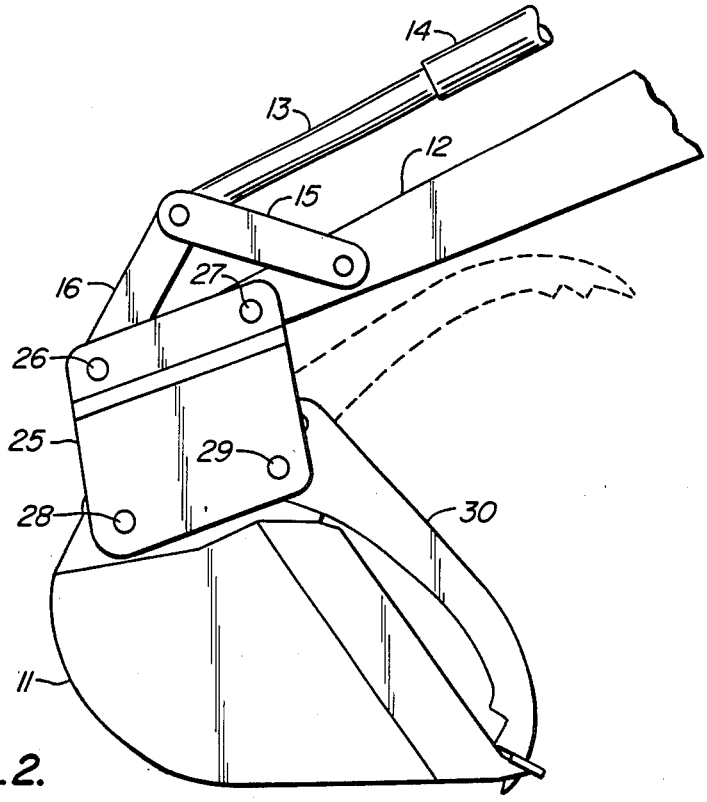
FIG. 2 is another side view of the boom-mounted tool shown in FIG. 1 with a grip attachment in accordance with the present invention installed.

In FIG. 2, the tool 11 has been disconnected from the other parts of the structure, and the entire structure reassembled with a gripping attachment 25 inserted between the bucket 11 and the boom 12 and other supporting parts. This gripping attachment is the extension piece referred to above in the Summary of the Invention. The upper side of the gripping attachment 25 is pivotally joined to the boom 12 and second pivot link 16 in the same manner that the bucket 11 was joined before it was attached, and the bottom end of the gripping attachement is joined to the bucket 11 at its previous points of connection to the boom and second pivot link. Thus, the original two pivot connections 19 and 20 are replaced by four new connections—two pivot connections 26, 27 at the top of the gripping attachment, and two nonpivoting connections 28, 29 at the bottom. With the gripping attachment in place, the piston 13 and cylinder 14 still operate in the same manner as before, drawing the first and second pivot links 15, 16 to the right. The entire gripping attachment 25 and bucket 11, however, are rotated as a unit around the pivot connection 27, maintaining the full range of motion of the bucket and even broadening the range by lengthening its radius. Each of the connections, 26, 27, 28 and 29, consists of an easily insertable pin. passing through holes in the various parts, appropriately sized to permit free rotation.

Part of the gripping attachment 25 is a pivoting claw 30, which is shown in two positions in FIG. 2—a closed position in solid lines where it rests against the bucket 11, and an open position in dashed lines.

Figure 3:
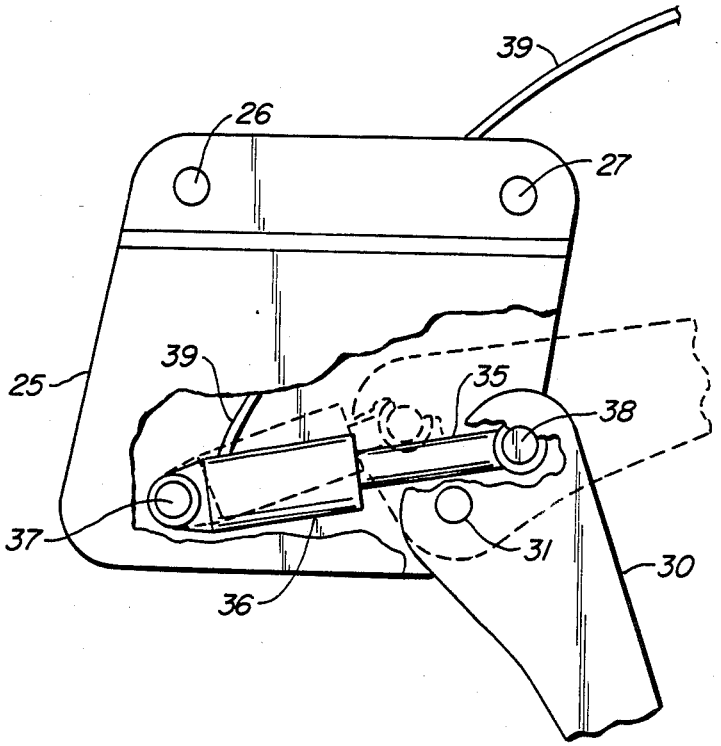
FIG. 3 is an enlarged view of the grip attachment shown in FIG. 2 with parts broken away to show its interior.

A closer look at the claw 30 and how it is mounted to the remainder of the grip attachment 25 may be seen in FIG. 3. A pivot connection 31 joins the parts. Again, the claw 30 is shown in two positions, the closed (solid lines) and the open (dashed lines). rotated 90° with respect to each other around the pivot connection 31. For convenience, this may be at the same location as the pivot connection 29 shown in FIG. 2, using a common pin.

Rotation of the claw 30 is controlled by a second extendable arm in the form of a piston 35 in cylinder 36, preferably hydraulically operated in a manner similar to the piston 13 and cylinder 14 of FIGS. 1 and 2, governing the position of the bucket 11. The piston and cylinder join the grip attachment housing to the claw 30 at appropriately placed pivot connections 37, 38. These are again conventional types of connections, although they may be nonremovable. For convenience, however, the pivot connection 37 between the cylinder 36 and the grip attachment housing 25 may be at the same location as the connection 28 between the grip attachment and the bucket 11 (FIG. 2). These two connections 37 and 28 may thus be coaxial and a single pin will serve to make the connections. A hydraulic supply line 39 supplies the fluid which operates the cylinder 36.

In the embodiment depicted in these drawings, the spacing between the upper two pivot connections 26. 27 on the grip attachment housing is approximately the same as the space between the lower two connections 28, 29 (which may be coaxial with the internal pivot connections 37 and 31 of the grip attachment). This will facilitate the substitution of the parts.

Figure 4:
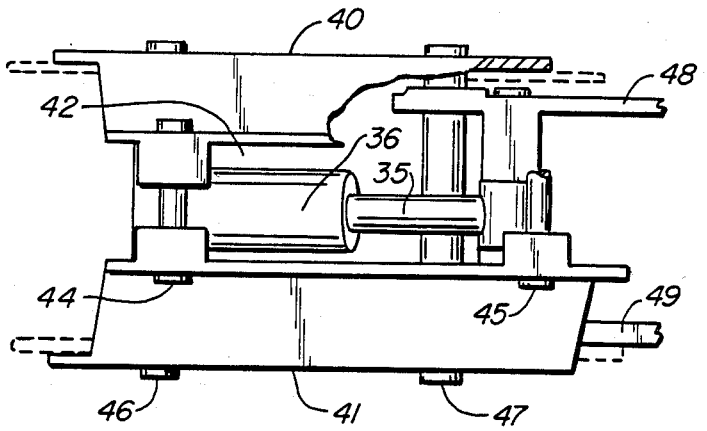
FIG. 4 is a top view of the grip mechanism shown in FIG. 3 with parts broken away to show its interior.

An upper view of the grip attachment is shown in FIG. 4. The grip attachment is constructed from two plates 40. 41, mounted to each other with an open space 42 in between. These plates may be individual plates bolted together or a single cast piece, or a single piece formed from one piece of steel. The piston 35 and cylinder 36 are retained entirely within the open space, fully protected against external objects which the equipment might strike as it is moved about. Also depicted in this drawing are the various pins 44, 45, 46, and 47 used in the connections 26, 27, 28 and 29 respectively.

It will also be noted that the claw 30 in this drawing contains two prongs 48, 49 for a more secure gripping. The portions of the bucket which connect to the grip attachment are shown in dashed lines.

The foregoing is offered primarily for purposes of illustration. It will be readily apparent to those skilled in the art that numerous variations and modifications of the various elements of the apparatus beyond those disclosed herein may be made without departing from the spirit and scope of the invention.

What is claimed is:

1. A grip attachment for a tool pivotally mounted to a boom through a first disengageable pivot connection and pivotable with respect thereto by a first extendable arm to which said tool is mounted through a second disengageable pivot connection, said grip attachment comprising:

a support member which is pivotally mountable to said boom and said first extendable arm at said first and second disengageable pivot connections, respectively, in place of and interchangeably with said tool;

means for mounting said tool to said support member;

a gripping member pivotally mounted to said support member; and a second extendable arm mounted to said support member and said gripping member to control the position of said gripping member relative to said support member.

2. A grip attachment in accordance with claim 1 in which said second extendable arm is comprises of a piston and cylinder.

3. A grip attachment in accordance with claim 1 in which said second extendable arm is comprised of a hydraulically operated piston and cylinder.

4. A grip attachment in accordance with claim 1 in which said support member is comprised of two plates mounted to each other with a space therebetween, said second extendable arm is mounted inside said space.

5. A grip attachment in accordance with claim 1 in which said mounting means mount said tool to said support member at locations on said tool where said first and second disengageable pivot connections are otherwise made.

6. A grip attachment in accordance with claim 1 in which said first and second disengageable pivot connections including a first pair of holes in said tool, separated by a selected distance, and a second pair of holes in said boom and said first extendable arm, respectively, likewise separated by said selected distance to permit alignment with said first pair of holes and connection therewith by the insertion of pivot pins, and said support member contains third and fourth Pairs of holes, each separated by said selected distance to permit simultaneous alignment with said first and second pairs of hole, respectively, for connection therewith by the insertion of pivot pins.

7. A grip attachment for a tool pivotally and detachably mounted to a boom and pivotable with respect to said boom by an extendable arm through a first pair of holes in said tool, separated by a selected distance, and a second pair of holes in said boom and said extendable arm, respectively, likewise separated by said selected distance, said grip attachment comprising:

a support member comprised of a pair of plates mounted to each other with a space therebetween, each said plate containing third and fourth pairs of holes, each said pair separated by said selected distance to permit simultaneous alignment with said first and second pairs of holes, respectively, for connection therewith by the insertion of pivot pins;

a gripping claw pivotally mounted to said support member; and a hydraulically operated piston and cylinder mounted in said space between said plates and joining said support member to said gripping claw to control the position of said gripping claw relative to said support member.

8. A combination boom-mounted tool and gripping claw, comprising:

a boom;

a first extendable arm mounted to said boom substantially parallel thereto;

a support member having a gripping claw pivotally mounted thereto;

a second extendable arm joining said support member and said gripping claw;

a tool;

means for exchangeably mounting said tool to (a) said boom and said first extendable arm in pivotal manner and (b) said support member, and for exchangeably mounting said boom and said first extendable arm to (c) said tool in pivotal manner and (d) said support member in pivotal manner.

9. A combination boom-mounted tool and gripping claw in accordance with claim 8 in which said second extendable arm is comprised of a piston and cylinder.

10. A combination boom-mounted tool and gripping claw in accordance with claim 8 in which said second extendable arm is comprised of a hydraulically operated piston and cylinder.

11. A combination boom-mounted tool and gripping claw in accordance with claim 8 in which said support member is comprised of two plates mounted to each other with a space therebetween, and said second extendable arm is mounted in said space.

12. A combination boom-mounted tool and gripping claw in accordance with claim 8 in which said exchangeable mounting means are comprised of a first pair of holes in said tool, separated by a selected distance, and a second pair of holes in said boom and said first extendable arm, respectively, likewise separated by said selected distance to permit alignment with said first pair of holes and connection therewith by the insertion of pivot pins, and third and fourth pairs of holes in said support member, each separated by said selected distance to permit simultaneous alignment with said first and second pairs of holes, respectively, for connection therewith by the insertion of pivot pins.

13. A combination boom-mounted tool and gripping claw, comprising:

a boom having a first mounting hole;

an extendable arm mounted to said boom substantially parallel thereto and having a second mounting hole;

a tool having a first pair of holes separated by a distance selected to align with said first and second mounting holes, respectively:

a support member comprised of a pair of plates mounted to each other with a space therebetween, each said plate having second and third pairs of holes, each said pair separated by said selected distance to permit simultaneous alignment with said first and second mounting holes and said first pairs of holes, respectively, for connection therewith by the insertion of pivot pins, and a gripping claw pivotally mounted thereto; and a hydraulically operated piston and cylinder retained in said space between said plates and joining said support member and said gripping claw to control the position of said gripping claw relative to said support member.

* * * * *